United States Patent [19]

Perry

[11] 4,005,549

[45] Feb. 1, 1977

[54] ABRASIVE FLOW MACHINING METHOD AND TOOLING

[75] Inventor: Kenneth E. Perry, Wellesley, Mass.

[73] Assignee: Dynetics Corporation, Woburn, Mass.

[22] Filed: July 28, 1975

[21] Appl. No.: 599,472

[52] U.S. Cl. ..... 51/8 H; 51/317

[51] Int. Cl.[2] ..... B24C 3/32; B24C 1/00

[58] Field of Search ..... 51/2 R, 7, 8 HI, 317, 51/318; 123/119 D, 141

[56] References Cited

UNITED STATES PATENTS

| | | | |
|---|---|---|---|
| 2,720,196 | 10/1955 | Wolf | 123/141 |
| 3,823,514 | 7/1974 | Tsuchiya | 51/317 X |
| 3,849,086 | 11/1974 | Johnson | 123/141 X |

FOREIGN PATENTS OR APPLICATIONS

| | | | |
|---|---|---|---|
| 766,183 | 1/1957 | United Kingdom | 123/141 |

*Primary Examiner*—Harold D. Whitehead
*Assistant Examiner*—James G. Smith
*Attorney, Agent, or Firm*—Sewall P. Bronstein; Donald Brown

[57] ABSTRACT

Method and Tooling for removing material from holes or orifices (round or other shapes) or the like in a workpiece, the method and tooling providing means for directing at least a first portion of an abrasive flow composition under pressure from a main body of composition from one side of a workpiece to another side of the workpiece (i.e. about the workpiece) so as to permit at least a second portion of the abrasive flow composition also under pressure from the same main body of composition to easily flow through the holes therein. In the preferred embodiment a first portion of the composition which is directed about the workpiece is returned to a point adjacent another side of the workpiece and is directed at an angle to the flow of the second portion of the composition through the holes in order to produce an interaction between the flow of said first and second portions of said composition.

17 Claims, 10 Drawing Figures

ABRASIVE FLOW MACHINING METHOD AND TOOLING

BACKGROUND OF THE INVENTION

This invention relates to abrasive flow machining and is more particularly directed to a new and improved method for flowing an abrasive flow composition and the tooling useful in practicing same. The present invention is particularly useful in radiusing small holes as well as in polishing the surfaces defining said holes e.g. in workpieces such as steel, aluminum, titanium and nickel alloy, et cetera. Abrasive flow machines are at this time well known in the art and are disclosed for example in U.S. Pat. Nos. 3,728,821; 3,769,751; 3,039,234; 2,346,228, among others.

Suitable abrasive flow compositions for use in this invention is disclosed in U.S. Pat. No. 2,346,228 or are sold by Dynetics Corp. of Woburn, Mass. under the trademark DYNAFLOW. As may be observed from the aforementioned U.S. Pat. Nos. 3,728,821 (FIG. 2) and 3,769,751 (FIG. 2) the flow of the abrasive composition is directly through holes in a workpiece held by a tool in order to remove material therefrom.

While such a machining scheme as shown in the aforementioned patents are quite useful where large diameter holes (e.g. greater than 20 mils diameter) are to be worked, it has been extremely difficult and in some cases well nigh impossible to force the flowable abrasive composition through small diameter holes such as to perform work thereon in a useful manner for commercial purposes. Using the prior art technique as shown in the aforementioned patents, abrasive flow through small holes in a workpiece when machining same essentially stops just as if the holes were in a sense absent or plugged up.

Thus a new and improved method and tooling therefore was needed to permit abrasive flow machining of small holes in workpieces i.e. holes less than 20 mils in width and as small as 1 to 5 mils in width. Applicant has unexpectedly discovered as will be disclosed herein a method and tooling for practicing same which permits machining of small holes.

As used herein the term abrasive flow machining of a hole is intended to mean the removal of material of the workpiece defining the hole so as to radius the entrance and exit of the hole as well as to polish same. The present invention is particularly applicable for abrasive flow machining of holes of extrusion dies or other perforated components.

The present discovery with certain modifications as will be disclosed herein also unexpectedly provides a solution to another problem which has plagued industry i.e. radiusing a large hole without substantial removal of the material between the exit and entrance of the hole such as holes in a jet engine rotor.

SUMMARY OF THE DISCLOSURE

This invention provides a new and improved method and tooling for abrasive flow machining of workpieces having small width e.g. diameter holes. In particular the invention provides a tool which includes means for directing at least a first portion of an abrasive flow composition about a workpiece i.e. from one side thereof to the opposite side thereof at the same time that at least a second portion of the abrasive flow composition is being pushed through said holes in order to permit the second portion of the composition to easily flow through the holes. Most preferably the first portion is directed back at a point adjacent the opposite surface of the workpiece in a manner such that it interacts with the second portion of the composition after it exits from the holes and apparently sets up a more turbulent flow condition in the second portion of the composition. The flow of first portion of the composition most preferably intersects the flow of the second portion of the composition at an angle (e.g. between 60° and 150° and most preferably 90°)and most preferably the first portion of the composition has imparted to it a tangential velocity component to apparently set up a swirl effect. The present invention also includes the method of imparting such flow characteristics to said abrasive flow composition in order to permit flow of said composition through small holes in a workpiece. Thus the present invention provides a new and improved method and tooling which permits small holes to be machined after they are drilled for example by lasers or using other hole drilling methods. With the present invention it is now possible to simultaneously abrasive flow machine groups of hundreds of holes in a single workpiece at the same time. For example the present process and tooling has been successfully applied to the machining of approximately 1000 1 mil holes ($D_2$ in FIG. 2A = 1 MIL) in a 3-½ inch diameter 5/16 inch thick workpiece as shown in FIGS. 1 to 2A.

It has also been discovered that this invention also has utility in cases where a larger radius is desired around the entrance and/or exit of a hole with minimal removal of metal from the surface defining the hole or holes. Thus it is now possible to machine large holes e.g. 50 to 500 mils or greater to radius same while not substantially removing material of the surface between the exit and entrance of the hole e.g. less than one (1%) percent stock removal from surface 21-1C in FIG. 2A.

DETAILED DESCRIPTION OF THE DISCLOSURE

Figure 1:
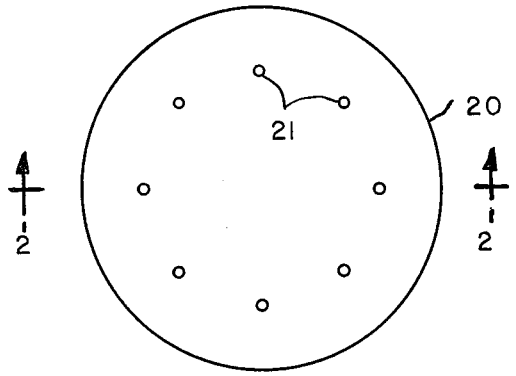
FIG. 1 is a top view of a workpiece which may be advantageously processed in the tool and method of this invention.
Figure 2:
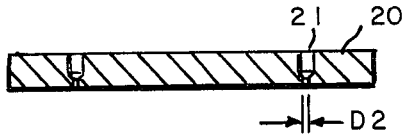
FIG. 2 a sectional view taken along line 2—2 in FIG. 1.
Figure 2A:
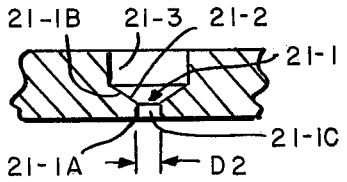
FIG. 2A is an enlarged sectional view of aperture 21.

Reference should now be had to FIGS. 1 to 4 for a description of the preferred embodiment of the invention. In FIGS. 1, 2 and 2A there is shown a typical workpiece 20 such as a metal extrusion die for extruding plastic and having a plurality of extrusion holes 21. The die typically comprises holes 21 of a small diameter which are to be radiused at 21-1A and 21-1B. FIG. 2A is an exploded view showing hole 21 of FIG. 2. In addition material is to be removed from the surface 21-1C between the exit and entrance of the first hole portion 21-1 in order to polish same. Abrasive flow composition is fed into the small diameter portion of the holes 21 ($D_2$) via counter bores comprising side bottom surface 21-2 and side surface 21-3.

The workpiece 20 may typically be 3-½ inches in diameter and 5/16 inch thick with the hole portion between corners or edges 21A and 21B typically being 2 mils in diameter (D2) and 30 mils in length.

Figure 3:
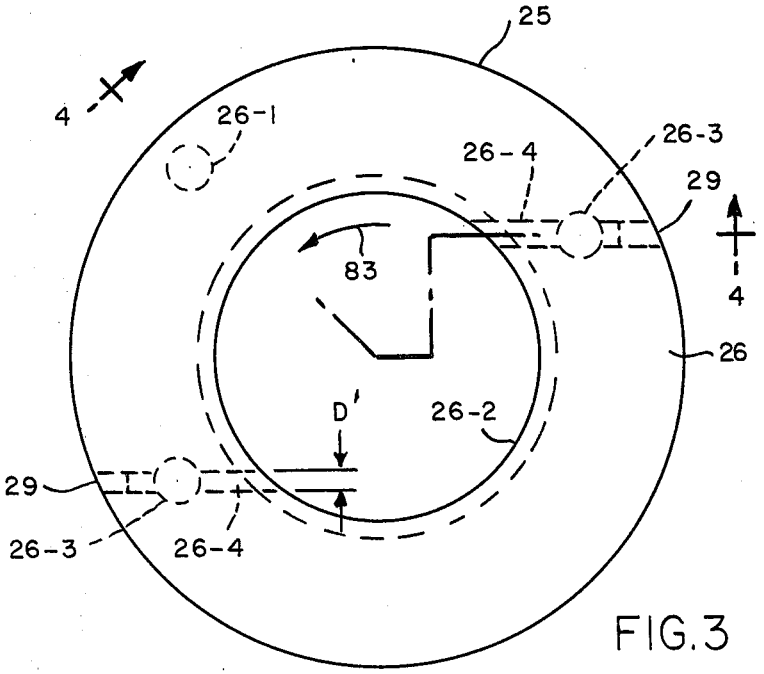
FIG. 3 is a top view of a tool useful in the method of this invention.
Figure 4:
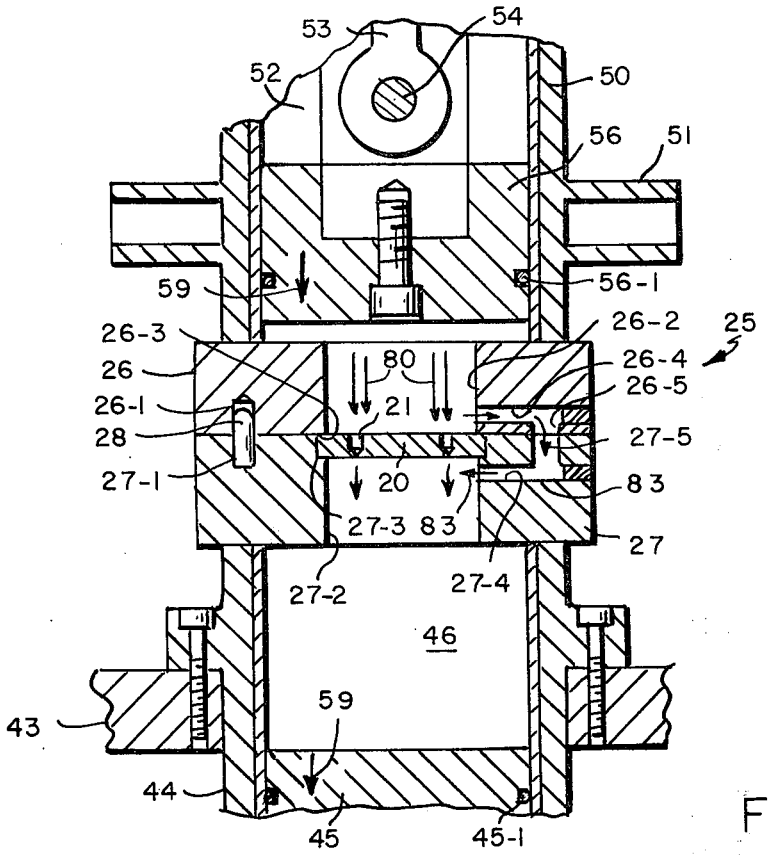
FIG. 4 is a sectional view showing the workpiece of FIG. 1 held in a tool of FIG. 3 taken along line 4—4 in FIG. 3 positioned in a typical abrasive flow machine.

In FIGS. 3 and 4 there is shown a suitable tool for performing machining on the workpiece of FIGS. 1, 2 and 2A according to the disclosure. The tool typically comprises two mating sections 26 and 27 which may for example be machined from nylon.

Section 26 may include a locating hole 26-1 which mates with a locating pin 28 fixedly supported in a hole 27-1 in the section 27. Section 26 also includes flow passage 26-2 which is in flow alignment with a flow passage 27-2 in the section 27. The workpiece 20 is supported as shown in FIG. 4 between a counterbore 27-3 in section 27 and an overhanging lip 26-3 of section 26 so that an abrasive flow composition may pass through the holes 21 of the workpiece 20 as it passes into and out of passages 26-2 and 27-2. At 26-4 and 26-5 and 27-4 and 27-5 in tool sections 26 and 27 respectively there are provided channels or passages forming a flow director for bringing a portion of an abrasive flow composition fed into opening 26-2 (see arrow 80) from one side of the workpiece 20 to a point adjacent the opposite side of the workpiece 20. In FIG. 4, the sectional view is only taken through one of said flow directors. It should also be understood that only one flow director is needed although two are shown in FIGS. 3 and 4. It should also be understood that if desired more than two flow directors may also be utilized. The flow director passages of one section e.g. 26 are in flow alignment with the flow director passages in the other section e.g. 27. In FIG. 4, the tool 25 with the workpiece 20 supported therein is shown positioned in a conventional abrasive flow machine such as shown in FIG. 2 of U.S. Pat. No. 3,769,751. The machine in FIG. 4 basically comprises a frame 43 to which there is mounted a lower cylinder 44 in which there is positioned a piston 45 having a seal 45-1. At the top of the machine there is provided a second cylinder 50 which is movable up and down and includes a block 52 coupled to piston 56 which in turn is coupled to a rod 53 coupled to pin 54. A piston seal is shown at 56-1. The cylinder 50 threaded about the outside thereof is moved downwardly to clamp the workpiece as shown in FIG. 4 by placing a tool in bored extentions 51. For a further understanding of this type of machine reference may be had to U.S. Pat. No. 3,769,751 issued Nov. 6, 1973. Since the actual machine used to practice the method of this invention as well as to use the tooling of this invention may change, it is intended that the method not be limited to the use of any particular abrasive flow machine. Referring again to FIG. 4, the method of operation is as follows: as piston 56 is forced downwardly as shown by arrow 59, abrasive flow composition positioned in area 57 is forced downwardly as shown by arrow 80 towards the workpiece 20. At this point a portion of the abrasive flow composition is forced through the holes 21 and exits therefrom as shown by arrow 84. At the same time a portion of the abrasive flow composition is directed away from the workpiece and into bypass passages 26-4, 26-5, 27-5, and 27-4. These passages direct the flow of a portion of the composition as shown by arrow 83. The flow of composition as shown by the arrow 83 is then directed at the composition 84 after it leaves the holes 21. Preferably the flow of the composition 83 as represented by the arrow 83 is preferably imparted with some swirl to increase the turbulence of the composition 84 upon interaction therewith. In order to effect same the channels 27-5 and 26-5 are preferably off center as shown. It should also be understood that while a swirl motion in the flow pattern represented by arrow 83 is desired for improved operation, such swirl motion is not necessary. The channels 26-4 and 27-4 may be formed by drilling from the outside as shown in FIGS. 3 and 4, threaded and then plugged at the end with a threaded plug 29 as shown. Upon leaving the workpiece and the channels 27-4 the abrasive flow composition represented by the arrows 83 and 84 combine and fall into the area 46 above piston 45 since piston 45 moves downwardly with piston 56. Thereafter the piston motion is reversed and the composition in area 46 is then forced through the channels 27-4, 27-5, 26-5, and 26-4 in a reverse manner to produce the same effect on the opposite side of the holes 21 of the workpiece 20.

In the construction FIGS. 3 and 4 the diameter $D_1$ is selected such that preferably a greater percentage of abrasive flow composition passes through the bypass passages 26-4, 26-5, 27-5, and 27-4 than through all of the holes 21 of the diameter $D_2$. Naturally the exact dimensions to achieve same will vary depending on the particular workpiece.

Figure 5:
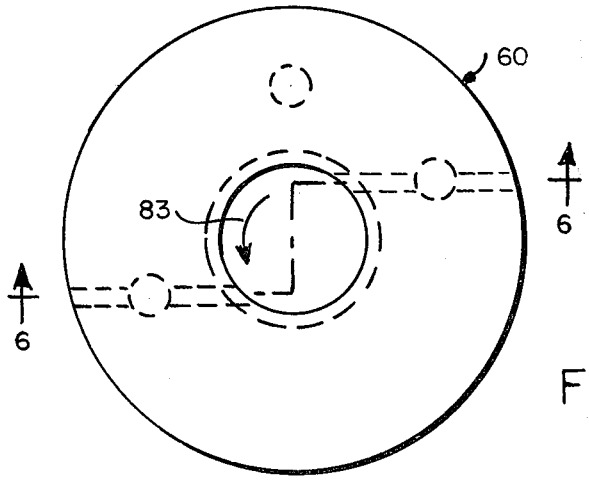
FIG. 5 is an alternate construction of a tool according to this invention for supporting a workpiece.
Figure 6:
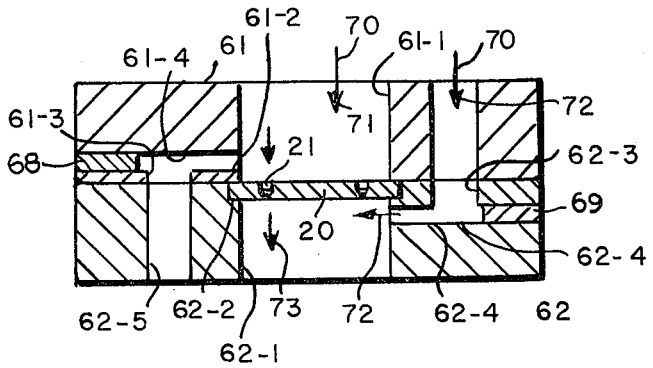
FIG. 6 is a sectional view taken along line 6—6 in FIG. 5.

Reference should now be had to FIGS. 5 and 6 which illustrate another tool suitable for practice of this invention. In this figure the workpiece is shown at 20 and has holes 21 as before. The tool is shown at 60 and comprises sections 61 and 62. The workpiece 20 is held between lip 61-2 and counterbore 62-2. Bypass passages are shown at 61-5, 62-3 and 62-4 and 62-5, 61-3 and 61-4. Plugs for the bypass passages are shown at 68 and 69. Abrasive composition flow is shown by arrow 70 representing the main body of composition. The flow into passage 61-1 is shown by arrow 71 and the flow into bypass passage is shown at 72. As shown the composition represented in arrow 72 is directed at the composition 73 exiting from the holes 21. Thus there is provided yet another scheme for practicing this invention. It should also be realized that some of the composition flowing into passage 61-1 is bled away at the same time through 61-4, 61-3 and 62-5.

Figure 7:
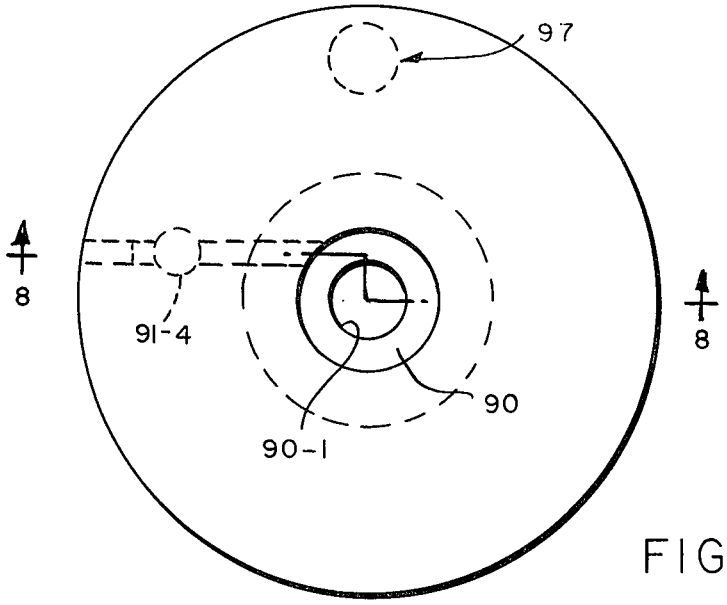
FIG. 7 is a top view showing a tool of this invention for radiusing a large diameter hole without removing substantial stock between the entrance and exit of the hole.
Figure 8:
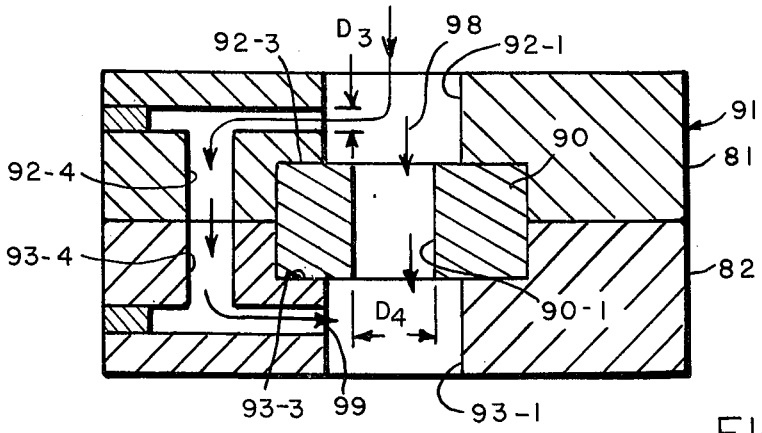
FIG. 8 is a sectional view taken along line 8—8 in FIG. 7.

At this time reference should now be had to FIGS. 7 and 8 which illustrate a tool 91 for radiusing a wide hole (i.e. entrance and exit thereof of Diameter $D_4$) of a workpiece 90 without removing substantial portion of the passage 90-1 between exit and entrance thereof. The tool in this Figure comprises locating means shown at 97 (the same type as shown for FIGS. 3 and 4) and flow passages 91-4 and 92-4 in sections 91 and 92. The interactive flow in this use is shown by the arrows 98 and 99 and produces radiusing as desired. In order to accomplish same without substantial stock removal in the passage 90-1, e.g. less than 1%, the diameter $D_3$ is made less than the diameter $D_4$ so that more abrasive flow is through passage 90-1. The main entry and exit passage for the tool 91 is shown at 91-1 and 92-1 respectively.

Figure 9:
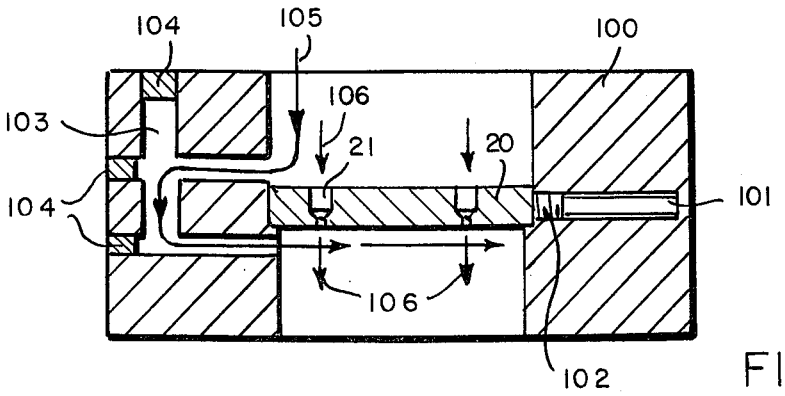
FIG. 9 is one piece tool for practicing this invention.

Reference should now be had to FIG. 9 which illustrates a one piece tool 100 useful in this invention. The workpiece is shown at 20 and includes holes 21. The workpiece is held in the tool by a set screw 102 held in threaded bore 101. The bypass flow is through passage 103 which is plugged as shown at 104. Abrasive composition flow is shown by arrows 105 and 106.

EXAMPLES

The following examples illustrate the preparation of suitable abrasive flow compositions with Examples 1, 2 and 3 illustrating components thereof prior to mixing with abrasive grit.

EXAMPLE 1

A polymer was formed from fifty pounds of a dimethyl silicone oil, ½ pound of $FeCl_3.6H_2O$ (Lewis acid catalyst) and three pounds of pyroboric acid by reaction at a temperature of 200°–250° C with agitation to form a highly viscous boron-organo silicon heteropolymer. This was reacted with 1½ pounds of $NH_4CO_3$ to neutralize any acid residue. The resulting material was somewhat brittle, stiff and crumbly.

A gel was formed by adding 3.6 pounds of aluminum stearate (No. 801, S. B. Penick and Co.) to 60 pounds of hydrocarbon oil (Drakol 9, Pennsylvania Refining Co.) at room temperature with stirring. The mixture was then heated to the gelation temperature of 194° F, heated further to 240° F and held at that temperature for 15 minutes to form a relatively thick gel.

Twenty pounds of the polymer were mixed with 30 pounds of the gel at a temperature of 215° F. After thorough mixing, the mixture was cooled and kneaded until it was homogenous.

EXAMPLE 2

Same as Example 1, except that in the gel naphthenic oil (Audobon 50, Getty Oil Co.) was substituted for the hydrocarbon oil of Example 1 with similarly good results. This mix was more dough-like in consistency.

EXAMPLE 3

21.1% by weight of the polymer of Example 1, 52.3% by weight of the gel of Example 2, and 26.6% by weight of 600 mesh silicon carbide grit was thoroughly mixed together in a mixer to form the abrasive flow composition. This abrasive flow composition is particularly useful for the small application as shown in FIGS. 1 to 4. In this case the holes were 1 mil ($D_2$), the diameter of workpiece was approximately two inches, the pressure was about 250 psi and time was about twenty-eight (28) secs. The bypass passages had an exit $D_1$ of ⅛ inch and the input passage 26-2 was 2¼ inches.

EXAMPLE 4

25.7% by weight of the polymer of Example 1, 31.9% by weight of the gel of Example 2, 25.7% by weight of 36 mesh silicon carbide grit, 12.8% of 320 mesh aluminum oxide grit and 3.9% of 600 mesh silicon carbide grit were throughly mixed to form an abrasive flow composition. Thereafter the composition was flowed through part 90 of FIGS. 7 and 8 as shown at 450 psi for approximately 4 minutes. The hole diameter $D_4$ = 0.323 inches. In this case the hole passage was opened less than 1% and the hole exit and entrance were radiused to 0.079 inches. The hole depth was 1.50 inches. The diameter $D_3$ of the exit or entrance was ⅛ inch.

It should be understood that the examples may be varied as would be apparent to those skilled in the art and thus the method or the tooling is not limited to the specific examples shown above.

I claim:

1. In an abrasive flow machine having means for passing an abrasive flow composition in two directions through a hole of a workpiece held by a tool having a first flow passage means in flow alignment with both ends of the hole of said workpiece, the improvement of said tool having a second flow passage means for diverting a portion of said abrasive flow composition away from said first flow passage means prior to it flowing through the hole of the workpiece and redirecting said diverted composition at the abrasive flow composition passing out of the hole of said workpiece and into said first fluid passage means when said composition is being passed through said workpiece in either direction.

2. In an abrasive flow machine of claim 1 in which said second flow passage means opens into said first flow passage means at two different points, said points being above and below the workpiece when said workpiece is held in the confines of said tool.

3. In an abrasive flow machine of claim 1 in which said second flow passage means is positioned off center with respect to said first flow passage means where it communicates therewith in order to impart a swirl to the diverted composition upon it entering said first flow passage means.

4. In an abrasive flow machine having means for providing an abrasive flow composition for passage through a hole of a workpiece held in the confines of a tool having a central flow passage means in flow alignment with either end of said hole, the improvement of a diversionary flow passage means for diverting a portion of said abrasive flow composition away from said central flow passage means and redirecting said diverted composition into said central flow passage means at a point which is off center from the center of the central flow passage means in order to impart a swirl to the diverted composition.

5. In the machine of claims 4 in which said central flow passage means is cylindrically shaped.

6. In the machine of claim 4 in which said diverted composition is directed against the portion of the composition passing through said hole of said workpiece after it has passed through the hole of the workpiece.

7. In the machine of claim 5 in which said diverted composition is directed against the portion of the composition passing through said hole of said workpiece after it has passed through the hole of the workpiece.

8. A method of abrasive flow machining a through hole in a workpiece which comprises supporting said workpiece in a tool, directing the flow of an abrasive flow composition under pressure towards said tool, directing the flow of a first portion of said abrasive flow composition at said hole of said workpiece at one side thereof, directing the flow of a second portion of said abrasive flow composition about said workpiece, and then directing the flow of said second portion of said composition against the flow of the first portion at a position adjacent another side of the workpiece at a point after the flow of said first portion of said composition has passed through said hole.

9. The method of claim 8 in which the amount of flow about the workpiece is greater than the amount of flow through the hole in the workpiece.

10. The method of claim 8 in which the workpiece includes a plurality of through holes and in which the flow through all of said holes in less than the flow about said workpiece.

11. The method of claim 8 in which the flow through the hole is greater than the flow about the workpiece.

12. The method of claim 8 in which the second portion of said composition is imparted with a tangential velocity component in order to cause swirling thereof.

13. A method of radiusing at least one small hole in a workpiece, said hole of a width of 20 mils or less which comprises flowing a first abrasive flow composition through the hole from one side of the workpiece and flowing a second abrasive flow composition at the first abrasive flow composition coming out of said hole at a point below the opposite side of said workpiece.

14. The method of claim 13 in which the amount of flow of said composition through said hole is less than the amount flow of said second composition directed against the first composition flowing through said hole.

15. The method of claim 14 in which the second composition is caused to swirl.

16. A method of radiusing a large hole without substantially removing surface material between the entrance and exit of the hole which comprises flowing a first abrasive flow composition through said hole and then directing a second abrasive flow composition at said first composition after it has left said hole, the flow of said abrasive composition being greater through the hole than the flow of the second composition directed at said first composition.

17. The method of claim 16 in which the second abrasive flow composition is imparted with a tangential velocity component in order to cause swirling thereof.

* * * * *